US011753227B2

(12) United States Patent
Yoshida

(10) Patent No.: US 11,753,227 B2
(45) Date of Patent: Sep. 12, 2023

(54) FILM-PACKAGED TISSUE ASSEMBLY PACKAGE AND METHOD FOR PRODUCING FILM-PACKAGED TISSUE ASSEMBLY PACKAGE

(71) Applicant: Daio Paper Corporation, Ehime (JP)

(72) Inventor: Shohei Yoshida, Shizuoka (JP)

(73) Assignee: Daio Paper Corporation, Ehime (JP)

( * ) Notice: Subject to any disclaimer, the term of this patent is extended or adjusted under 35 U.S.C. 154(b) by 0 days.

(21) Appl. No.: 17/763,284

(22) PCT Filed: Sep. 23, 2020

(86) PCT No.: PCT/JP2020/035746
§ 371 (c)(1),
(2) Date: Mar. 24, 2022

(87) PCT Pub. No.: WO2021/065604
PCT Pub. Date: Apr. 8, 2021

(65) Prior Publication Data

US 2022/0340346 A1 Oct. 27, 2022

(30) Foreign Application Priority Data

Oct. 1, 2019 (JP) ..... 2019-181557

(51) Int. Cl.
*B65D 85/48* (2006.01)
*B65D 75/58* (2006.01)
(Continued)

(52) U.S. Cl.
CPC ..... *B65D 75/5833* (2013.01); *B65B 5/022* (2013.01); *B65B 5/067* (2013.01);
(Continued)

(58) Field of Classification Search
CPC .. B65D 75/5833; B65D 71/063; B65D 77/04; B65D 83/0894; B65D 2571/0045;
(Continued)

(56) References Cited

U.S. PATENT DOCUMENTS 4,574,952 A * 3/1986 Masui ..... B65D 83/0835 221/48
5,613,608 A * 3/1997 Tronchetti ..... B65D 83/0847 206/812

(Continued)

FOREIGN PATENT DOCUMENTS

JP 2018-058654 A 4/2018
JP 2018-172130 A 11/2018

*Primary Examiner* — Luan K Bui
(74) *Attorney, Agent, or Firm* — Renner, Kenner; Arthur M. Reginelli

(57) ABSTRACT

Provided is a film-packaged tissue assembly package in which an outlet forming portion is not unintentionally broken.

The problem is solved by a film-packaged tissue assembly package in which a plurality of substantially hexahedron-shaped film-packaged tissues having an upper surface having an outlet forming portion are arranged and packaged in a gusset packaging bag having a grip portion on the top surface side, wherein a plurality of film-packaged tissues are arranged in a substantially rectangular parallelepiped shape in such a manner that the end surfaces face the top surface side where the grip portion is provided, and a bottom surface side facing the top surface side, and the film-packaged tissue is packaged in such a manner that the outlet forming portion has a shape in which an easily tearable line having cut portions and non-cut portions arranged alternately protrude toward the outside, the interval between non-cut portions at one end portion is smaller than the interval between non-cut portions at (Continued)

the other end portion, and the side where the end portion with a smaller interval between non-cut portions is located on the top surface side.

9 Claims, 13 Drawing Sheets

(51) Int. Cl.

| | |
|---|---|
| ***B65B 5/02*** | (2006.01) |
| ***B65B 5/06*** | (2006.01) |
| ***B65B 7/06*** | (2006.01) |
| ***B65D 71/06*** | (2006.01) |
| ***B65D 77/04*** | (2006.01) |
| ***B65D 83/08*** | (2006.01) |

(52) U.S. Cl.
CPC ..... *B65B 7/06* (2013.01); *B65D 71/063* (2013.01); *B65D 77/04* (2013.01); *B65D 83/0894* (2013.01); *B65D 2571/0045* (2013.01); *B65D 2571/0058* (2013.01); *B65D 2571/00672* (2013.01); *B65D 2571/00734* (2013.01); *B65D 2577/043* (2013.01)

(58) Field of Classification Search
CPC .. B65D 2571/0058; B65D 2571/00672; B65D 2571/00734; B65D 2577/043; B65B 35/30; B65B 35/50
USPC ..... 206/449, 494; 53/443, 447; 229/200, 229/205, 207, 240
See application file for complete search history.

(56) References Cited

U.S. PATENT DOCUMENTS

| | | | | |
|---|---|---|---|---|
| 6,296,144 | B1 * | 10/2001 | Tanaka | B65D 83/0894 221/45 |
| 7,992,744 | B2 * | 8/2011 | Szymonski | B65D 83/0835 221/39 |
| 2002/0063136 | A1 * | 5/2002 | Sauer | B65D 5/4208 206/806 |
| 2003/0217946 | A1 * | 11/2003 | Hsu | B65D 83/0805 206/494 |
| 2005/0258061 | A1 * | 11/2005 | Vandecruys | B65D 83/0805 206/425 |
| 2010/0155272 | A1 * | 6/2010 | Ottman | B65D 83/0894 206/233 |
| 2010/0252475 | A1 * | 10/2010 | Konuma | B65D 83/0894 206/494 |
| 2020/0069119 | A1 | 3/2020 | Yoshida | |

* cited by examiner (A)

(B)

FILM-PACKAGED TISSUE ASSEMBLY PACKAGE AND METHOD FOR PRODUCING FILM-PACKAGED TISSUE ASSEMBLY PACKAGE

TECHNICAL FIELD

The present invention relates to a film-packaged tissue assembly package in which a plurality of film-packaged tissues each obtained by packaging a tissue paper bundle having folded and stacked tissue paper with a flexible packaging film are collectively gusset-packaged, and a method for producing the film-packaged tissue assembly package.

BACKGROUND ART

As the tissue paper package, a tissue paper package also referred to as a film-packaged tissue is known in which a tissue paper bundle is packaged with a flexible packaging film made of resin. As the film-packaged tissue, one referred to as a pocket tissue and suitable for portable use is well known, and there is also a film-packaged tissue that is used in a stationary manner like a film-packaged tissue that is called a box tissue in which a tissue paper bundle is included in a paper storage box called a carton box (hereinafter, also referred to as a box product), or used for refilling of a bundle of a box product.

Such a film-packaged tissue used mainly in a stationary manner is a so-called pop-up type in which when the uppermost sheet of the included bundle is drawn out from the included bundle, a part of the next sheet is drawn out. The film-packaged tissue is more advantageous than a box product in reduction of packaging materials, and transportation cost reduction and portability associated with compactness.

On the other hand, in a conventional film-packaged tissue, the perforation for forming an outlet on the upper surface is generally a simple linear slit-type perforation for reducing the cost as shown in Patent Literature 1.

However, such a slit-shaped outlet formed by opening a perforation has a problem that in particular, if the slit length is increased, the sheet falls to the inside when the number of sheets remaining inside decreases, and if the slit length is reduced, it is difficult to draw out a sheet to the outside of the film first after opening, and resistance to drawing at the initial stage of use is so high that the sheet is lifted together with an outer packaging film when drawn out.

Thus, for solving such a problem, a perforation for forming an outlet is arranged in a thin and long annular shape extending in a longitudinal direction to widen the opening of the outlet (Patent Literature 2 below).

On the other hand, like a box product, such a film-packaged tissue used mainly in a stationary manner is often sold as an assembly-packaged product form in which a plurality of tissues, e.g. five or three tissues are bundled by an outer packaging film.

For assembly-packaging of film-packaged tissues, in particular, an assembly package of a film-packaged tissue which is different from a tissue for portable use and is used mainly in a stationary manner, etc. has a certain level of volume, and thus is preferably a gusset packaging with a grip portion for easy carriage.

However, in gusset packaging, spaces are formed particularly on the top surface side and the bottom surface side because of the structure, and therefore when five or three film-packaged tissues are arranged in such a manner as to be stacked in a vertical direction in a vertically abutting manner as in the case of a box product, shape stability is lost, so that when a large number of tissues are stacked at a storefront to be sold at a store etc., the tissues may collapse.

Thus, rather than being arranged in such a manner as to be stacked in a vertical direction, film-packaged tissues are arranged side by side in a traverse direction orthogonal to the vertical direction, compressed, and gusset-packaged in such a manner as to be bound by an assembly-packaging film in this compressed state, so that the tissue has high shape retainability as a whole, and is suitable for stacked display at a storefront (Patent Literature 2).

CITATION LIST

Patent Literature

Patent Literature 1: JP 2018-172130 A
Patent Literature 2: JP 2018-058654 A

SUMMARY OF INVENTION

Technical Problem

However, it has been found that when an outlet forming portion is formed so as to be annularly arranged particularly for improving the sheet drawability in the case where a plurality of film-packaged tissues are arranged in a traverse direction orthogonal to a vertical direction and gusset-packaged as in Patent Literature 2, there are cases where a gusset packaging film forming the gusset packaging is rubbed against a packaging film forming the film-packaged tissue, so that the outlet forming portion is turned up.

In addition, if the film-packaged tissue is excessively compressed and assembly-packaged so that the gusset packaging film is not rubbed against the packaging film forming the film-packaged tissue, the fullness of the tissue paper may be reduced particularly when the compressed state lasts for a long period of time.

Accordingly, a main object of the present invention is to provide a film-packaged tissue assembly package in which a plurality of film-packaged tissues each having an outlet forming portion having a non-slit-shaped annular portion at an end portion are arranged side by side in a traverse direction orthogonal to a vertical direction, and gusset-packaged, and the outlet forming portion is hardly rubbed against the gusset packaging film and turned up; and a method for producing the film-packaged tissue assembly package. Further, the film-packaged tissue assembly package is resistant to reduction of the fullness of included tissue paper, and is excellent in shape retainability so as to be easily stacked and sold at a storefront.

Solution to Problem

The means for achieving the above-described object is as follows.

The first means is:

a film-packaged tissue assembly package including a gusset packaging bag having a grip portion on the top surface side; and a plurality of substantially hexahedron-shaped film-packaged tissues each having an upper surface having an outlet forming portion, a lower surface facing the upper surface, and an end surface and a long side surface located between the upper surface and the lower surface, the plurality of film-packaged tissues being arranged and packaged in the gusset packaging bag, wherein a plurality of film-packaged tissues are arranged in a substantially rectangular parallelepiped shape in such a manner that the end surfaces face the top surface side where the grip portion is provided, and a bottom surface side facing the top surface side, and the end surface are substantially flush with each other and the long side surfaces are substantially flush with each other, and the film-packaged tissue is packaged in such a manner that the outlet forming portion is formed by an easily tearable line having cut portions and non-cut portions arranged alternately, and has a shape in which both end portions in a longitudinal direction protrude toward the outside, the interval between non-cut portions at one end portion being smaller than the interval between non-cut portions at the other end portion, and the side where the end portion with a smaller interval between non-cut portions being located on the top surface side.

The second means is:

the film-packaged tissue assembly package according to the first means, wherein the end portion with a larger interval between non-cut portions is formed by a slit cut, and the end portion with a smaller interval between non-cut portions is formed by a perforation.

The third means is:

the film-packaged tissue assembly package according to the first or second means, wherein both ends of the outlet forming portion for the film-packaged tissue in the longitudinal direction are cut portions.

The fourth means is:

the film-packaged tissue assembly package according to the first or second means, wherein among the end portions of the outlet forming portion for the film-packaged tissue in the longitudinal direction, the longitudinal-direction end on the end portion side with a smaller interval between non-cut portions is a non-cut portion, the longitudinal-direction end on the end portion side with a longer interval between non-cut portions is a cut portion, the end portion on a side where the non-cut portion is present is located on the top surface side, and the end portion on a side where the cut portion is present is located on the bottom surface side.

The fifth means is:

the film-packaged tissue assembly package according to the first to fourth means, wherein the film-packaged tissue paper is an overwrap-packaged product of a tissue paper bundle having a substantially rectangular solid shape in which a plurality of tissue papers are folded and stacked, and an end surface formed by a barrel opening sealing portion is positioned so as to face a short side surface of the bundle.

The sixth means is:

the film-packaged tissue assembly package according to the first to fourth means, wherein in the gusset packaging bag, the film-packaged tissues are arranged in a plurality of stages in the vertical direction in such a manner that the end surfaces of the film-packaged tissues are abutted against each other.

The seventh means is:

the film-packaged tissue assembly package according to the first to sixth means, wherein a compression ratio in a direction orthogonal to the vertical direction of a film-packaged tissue assembly arranged in the gusset packaging bag is 80% or more.

The eighth means is:

a method for producing film-packaged tissue assembly package, the method including:

forming a film-packaged tissue assembly by disposing a plurality of substantially hexahedron-shaped film-packaged tissues, in which an outlet forming portion is formed on un upper surface, where the outlet forming portion has a shape in which an easily tearable line having cut portions and non-cut portions arranged alternately protrudes toward the outside from a longitudinal-direction end portion, and the interval between the cut portion and the non-cut portion at one end portion is smaller than the interval between the cut portion and the non-cut portion at the other end portion, and the film-packaged tissue has a lower surface facing the upper surface, and an end surface and a long side surface located between the upper surface and the lower surface, with the end surfaces being substantially flush with each other and the long side surfaces being substantially flush with each other, so that the film-packaged tissues are arranged in a substantially rectangular parallelepiped shape;

inserting the film-packaged tissue assembly into a bag closed on one side or a barrel-shaped film opened at both ends, which is a precursor of a gusset packaging bag, from the side where the end portion with a small interval between the cut portion and the non-cut portion; and sealing the opening of the bag or the barrel-shaped film to perform gusset-packaging.

The ninth means is:

the method for producing a film-packaged tissue assembly package according to the eighth means, further including compressing the film-packaged tissue assembly in a direction along which the upper and lower surfaces are arranged.

Advantageous Effects of Invention

According to the present invention, there is provided a film-packaged tissue assembly package in which a plurality of film-packaged tissues each having an outlet forming portion having a non-slit-shaped annular portion at an end portion are arranged side by side in a traverse direction orthogonal to a vertical direction, and gusset-packaged, and the outlet forming portion is hardly rubbed against the gusset packaging film and turned up; and a method for producing the film-packaged tissue assembly package. In addition, there is provided a film-packaged tissue assembly package which is resistant to reduction of the fullness of tissue papers and excellent in shape retainability so that the package is easily stacked and sold at a storefront, etc.

DESCRIPTION OF EMBODIMENTS

Figure 1:
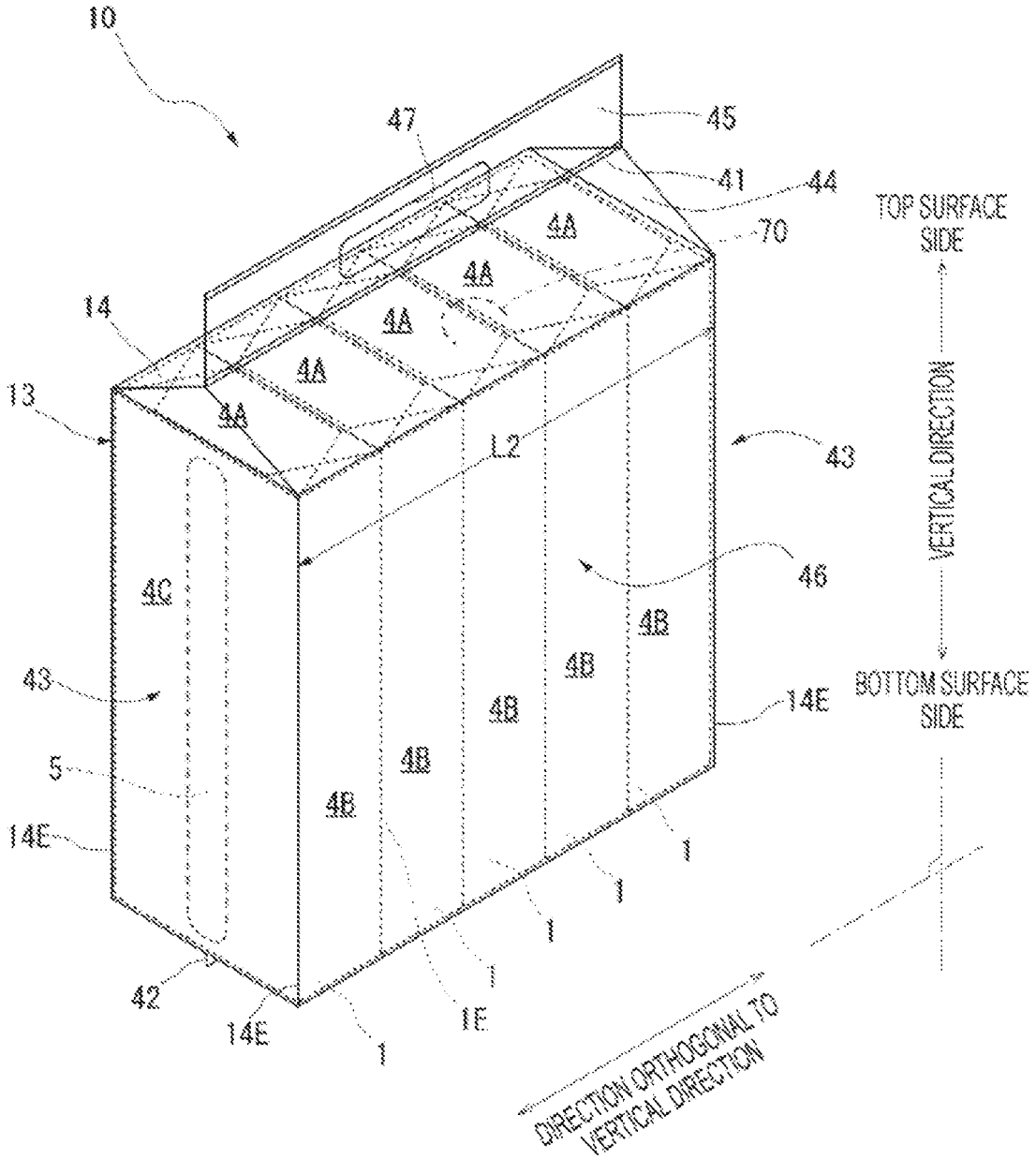
FIG. 1 is a perspective view of a film-packaged tissue assembly package according to the present invention.

Hereinafter, the present invention will be described with reference to FIGS. 1 to 13 corresponding to the embodiment of the present invention.

In a film-packaged tissue assembly package 10 (hereinafter, also referred to as an assembly package) according to the present invention, a plurality of film-packaged tissues 1 in which a bundle 3 obtained by folding and stacking a plurality of sets of tissue paper 2 is packaged with a flexible packaging film 4 are arranged and gusset-packaged so as to be included in a gusset packaging bag 13 having a grip portion 45 on the top surface side.

Figure 3:
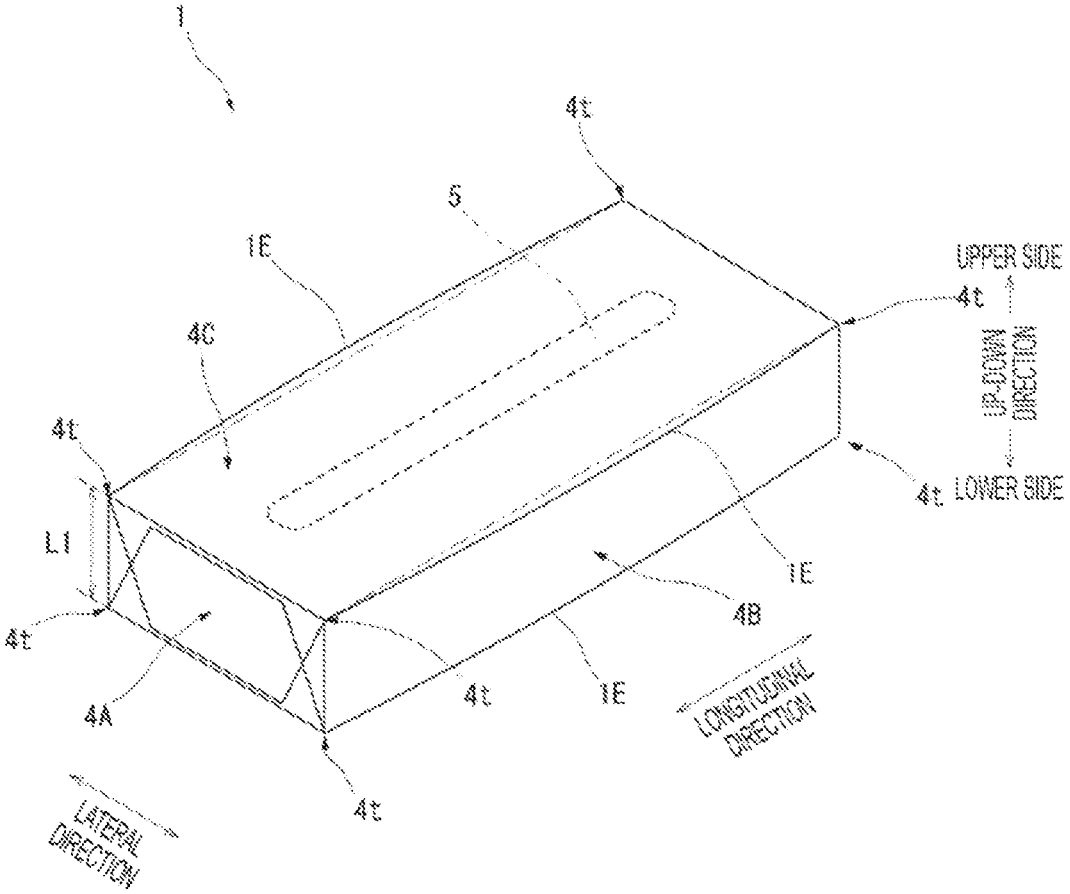
FIG. 3 is a perspective view for illustrating a film-packaged tissue according to the present invention.
Figure 8:
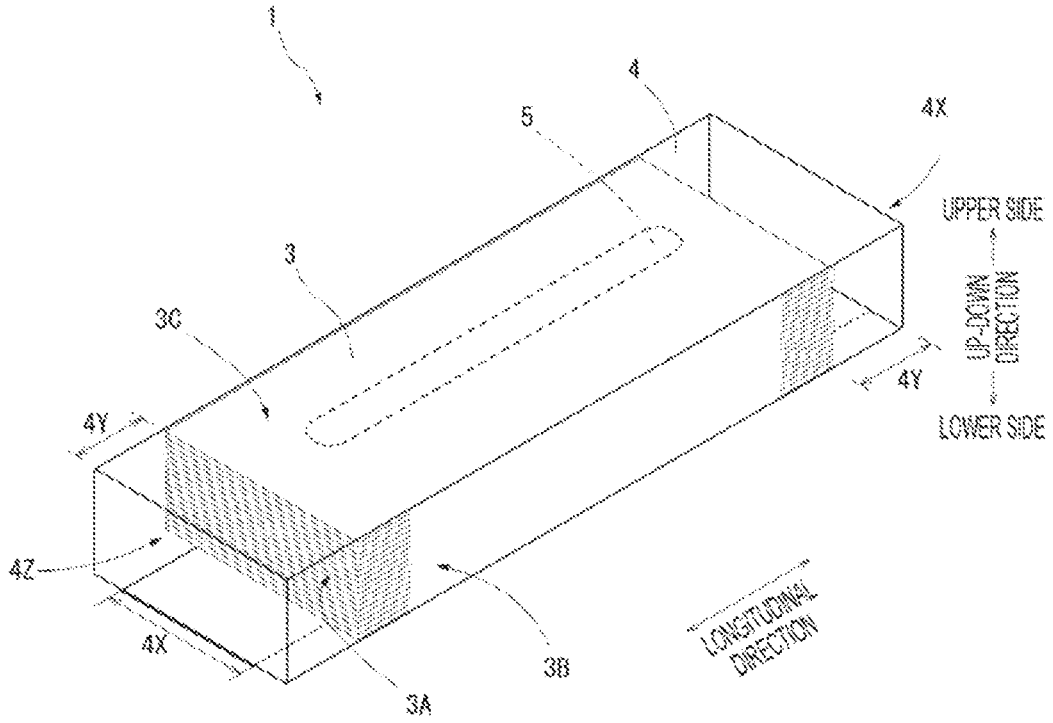
FIG. 8 is a perspective view for illustrating a packaging structure of a film-packaged tissue according to the present invention.
Figure 9:
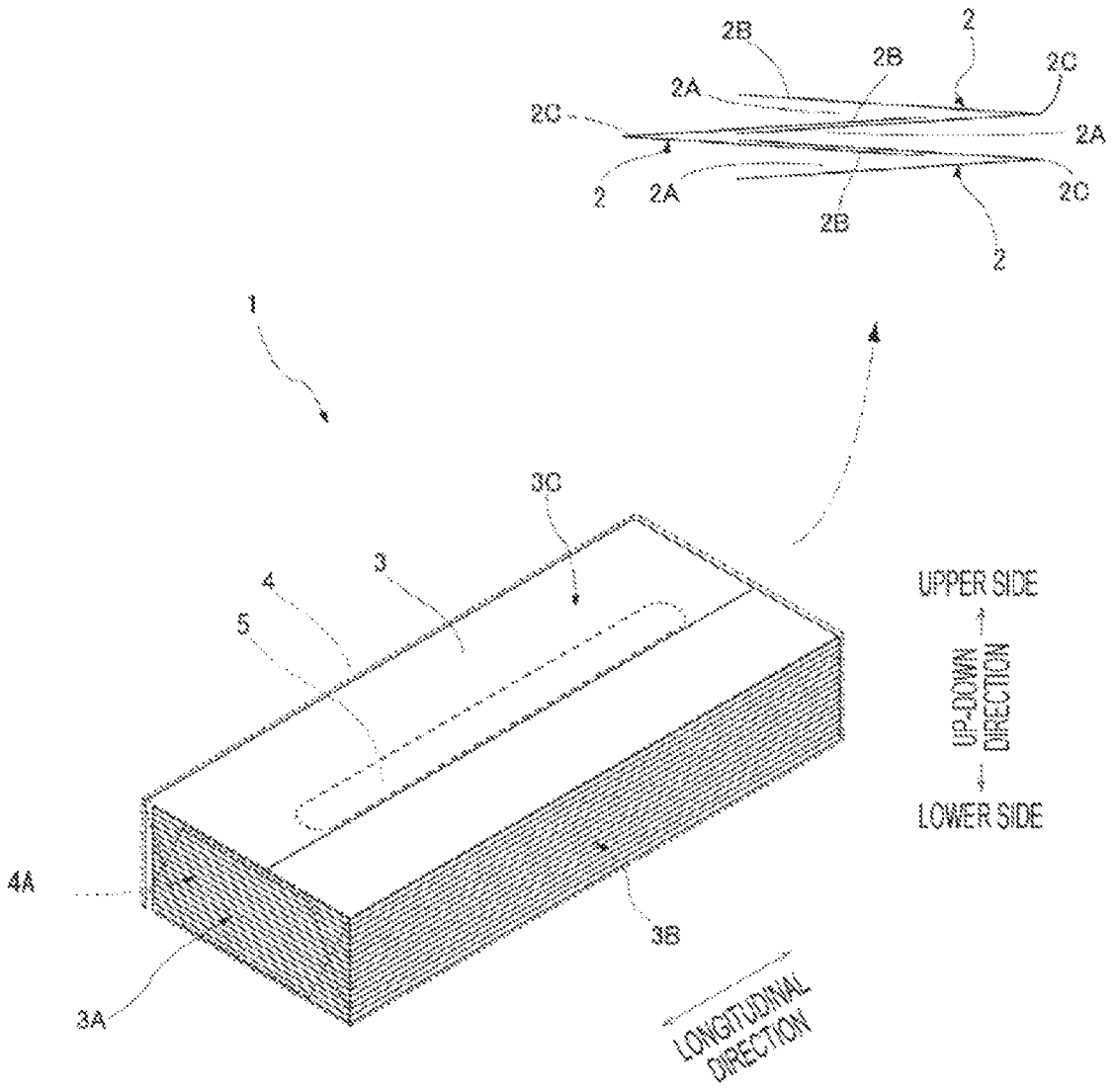
FIG. 9 is a perspective view for illustrating a tissue paper bundle according to the present invention.
Figure 10:
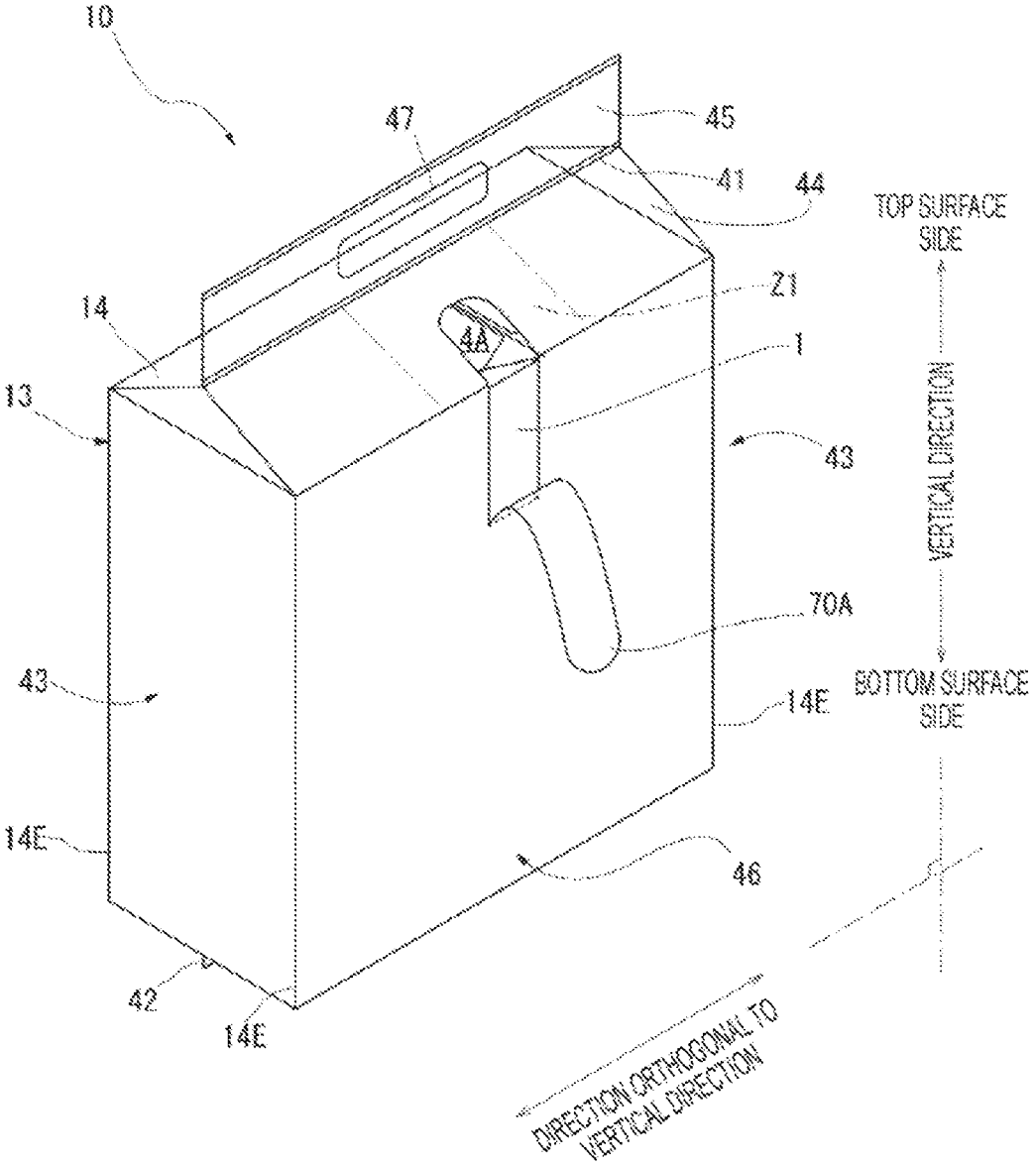
FIG. 10 is a perspective view showing an example of an opened state of a film-packaged tissue assembly package according to the present invention.

A film-packaged tissue 1 according to the present invention is obtained by pillow-packaging or overwrap-packaging the bundle 3, and has a substantially hexahedron shape having an upper surface having an outlet forming portion, a lower surface facing the upper surface, and an end surface and a long side surface located between the upper surface and the lower surface. Preferably, the bundle is overwrap-packaged. The overwrap packaging is a wrapping mode also referred to as caramel packaging or mating wrapping packaging. In particular, as shown in FIGS. 3, 8 and 9, the bundle 3 as an article to be packaged is wrapped in a rolled manner in a barrel shape with the packaging film 4 so as to form an opening 4Z at each of both ends in a longitudinal direction, a portion 4X superposed in the rolling direction is bonded by welding treatment or with an adhesive, a portion 4Y extending beyond the bundle 3 is folded to the end surface side of the bundle 3 from the vicinity of two opposed edges of the bundle end surface, at least the tip edge portions of a substantially triangular or trapezoidal piece formed at this time are superposed and bonded to each other by welding treatment or with an adhesive to seal the barrel opening 4Z, thus forming an end surface 4A.

Figure 2:
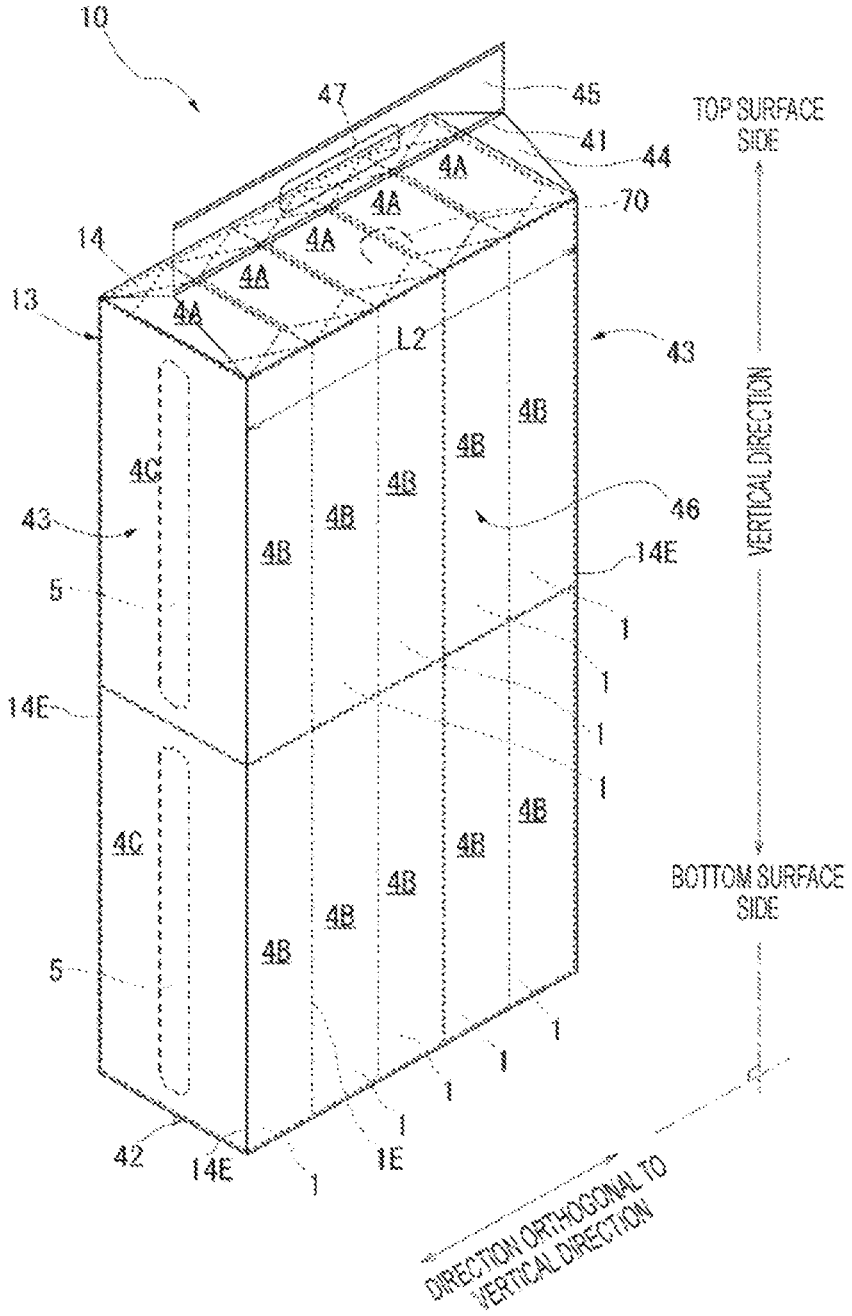
FIG. 2 is a perspective view of another film-packaged tissue assembly package according to the present invention.

In the overwrap packaging, the end surface 4A has a substantially planar shape, so that the outer packaging of the packaging film 4 has a substantially rectangular parallelepiped shape closer to a box. In addition, the end surface 4A has high stiffness, is hardly crushed, and easily maintains a substantially rectangular parallelepiped shape because the packaging film 4 is formed by staking and bonding a plurality of layers. Therefore, when the film-packaged tissue 1 is overwrap-packaged, the product shape is substantially rectangular parallelepiped, and therefore, as shown in FIGS. 1 and 2, the tissues can generally have a substantially rectangular parallelepiped shape even when arranged and assembly-packaged. Thus, the assembly packages are easily stacked in line in a plurality of stages, and easily stacked and sold at a storefront. In addition, the stiffness of the packaging from the packaging film 4 is high, so that even when the packages are stacked in this manner, the a compressive force is hardly applied to the inside bundle 3, and thus the fullness of the tissue paper 2 is hardly deteriorated.

The above-described pop-up type bundle 3 has a substantially rectangular solid shape having a pair of long side surfaces 3B on which the folded edges 2C of the respective tissue papers 2 are arranged, a pair of short side surfaces 3A on which the folded edges 2C are not arranged, and further a pair of planar surfaces (upper and lower surfaces) 3C connected to the short side surfaces 3A and the long side surfaces 3B. In addition, the bundle has flexibility and is easily compressed and deformed because it is composed of soft tissue paper 2.

The number of sets of tissue paper 2 forming the bundle 3 is not limited, and is generally 100 to 240 with 2 plies (two sheets stacked) or 3 plies (three sheets stacked) set to one set. The size of the bundle 3 is not necessarily limited, and a bundle of 150 sets of 2-ply tissue paper is approximately 40 to 50 mm in height, 160 to 200 mm in longitudinal direction (width) and 90 to 110 mm in lateral direction (depth). As is apparent from this shape, the film-packaged tissue 1 according to the present invention is not a portable tissue so called a pocket tissue etc. in which the number of sets of included tissue paper is about 10 to 12 and the height is about 10 mm.

In the film-packaged tissue 1 having the illustrated configuration, the end surface 4A formed by sealing the barrel opening 4Z is present at a position facing the short side surface 3A of the bundle 3, and the outlet forming portion 5 is formed at a position facing the uppermost tissue paper 2 of the bundle 3 of the packaging film 4. In particular, the film-packaged tissue 1 is obtained by overwrap-packaging the pop-up type bundle 3 of substantially rectangular solid-shaped tissue paper 2 in which the tissue paper 2 is folded in two and a plurality of tissue papers 2 are folded and stacked such that folded pieces 2B of other tissue papers 2 located on the upper side and the lower side are located on the folded inner side 2A, the outlet forming portion 5 for tissue paper is present on the upper surface, and the end surface 4A as a sealing portion of the barrel opening 4X is located so as to face the short side surface 3A on which the folded edges 2C of the bundle 3 are not arranged.

In the bundle 3 of a pop-up type as in the illustrated configuration, when the uppermost tissue paper 2 of the bundle 3 is drawn out from the outlet, a part of the next tissue paper located immediately below the uppermost tissue paper 2 is exposed to the outlet through the opening. In addition, the film-packaged tissue 1 configured as described above has a structure in which tissue paper is stacked in a direction along which the end surface 4A having high stiffness rises, so that even if a compressive force from the bundle stacking direction (up-down direction) is applied, and the bundle 3 is hardly compressed, and thus fullness is hardly deteriorated.

In the film-packaged tissue 1, a suction and exhaust hole communicating with the inside and the outside may be formed for preventing rupture or the like in case of application of an external force in pillow packaging and overwrap packaging. However, in the case of overwrap packaging, the end surface 4A facing the short side surface 3A on which the folded edges 2C of the bundle 3 of the packaging film 4 are not arranged may be provided with a suction and exhaust hole, but it is desirable that there be no suction and exhaust hole at this position. When the end surface 4A is provided with a suction and exhaust hole, the end surface 4A becomes more fragile, so that the advantage of overwrap packaging that the end surface 4A has high stiffness is compromised.

Here, the outlet forming portion 5 according to the present invention is formed along a longitudinal direction at the central portion of the upper surface 4C in the lateral direction. The outlet forming portion 5 can be formed by an easily tearable line in which cut portions 50C and non-cut portions 50U, also called as tie portions, are alternately arranged. An outlet for drawing out tissue paper 2 is formed on the upper surface 4C of the film-packaged tissue 1 by separating and removing an area surrounded by the easily tearable line. Examples of the easily tearable line include, but are not limited to, slit cuts provided with perforations and uncut portions (non-cut portions). The slit cut provided with the perforation and the non-cut portion may be partially separately arranged. The easily tearable line can be formed by, for example, die cutting. The type of the perforation is not limited. Examples thereof include normal perforations having linear cut portions, microperforations having hole cut portions, and perforations having Y-shaped cuts, substantially L-shaped cuts and ←shaped cuts. Normal perforations are preferable. The slit cut is a portion in which the film is cut in a slit shape, and when non-cut portions are present, and non-cut portions and cut portions are alternately arranged. The slit cut having non-cut portions may be simply referred to as a slit cut. Slit cuts having perforations and non-cut portions can be formed by die cutting in parallel and in such a manner that the cut portions continue with the non-cut portions therebetween. Therefore, there may be no discrimination, but in the present invention, the slit cut is referred to as a slit cut when the pitch of cut portions is less than 3, i.e. three cut portions having the same length do not continue. In the slit cut, the cut portion generally has a length larger than that of the perforation.

Figure 4:
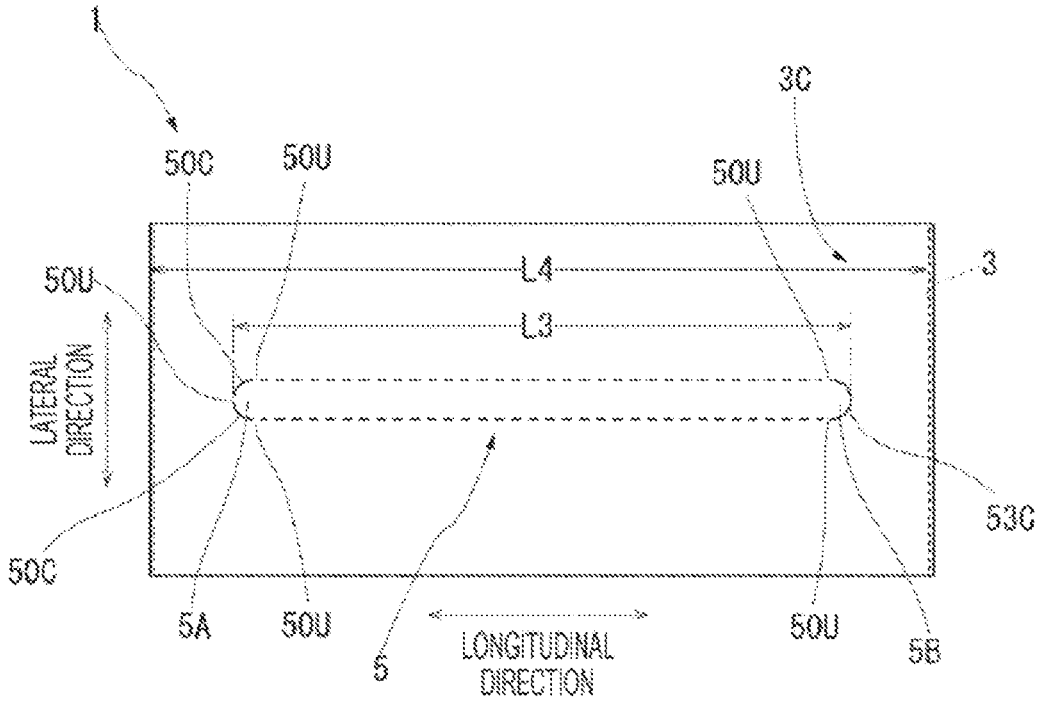
FIG. 4 is a top view for illustrating an outlet forming portion for a film-packaged tissue according to the present invention.
Figure 5:
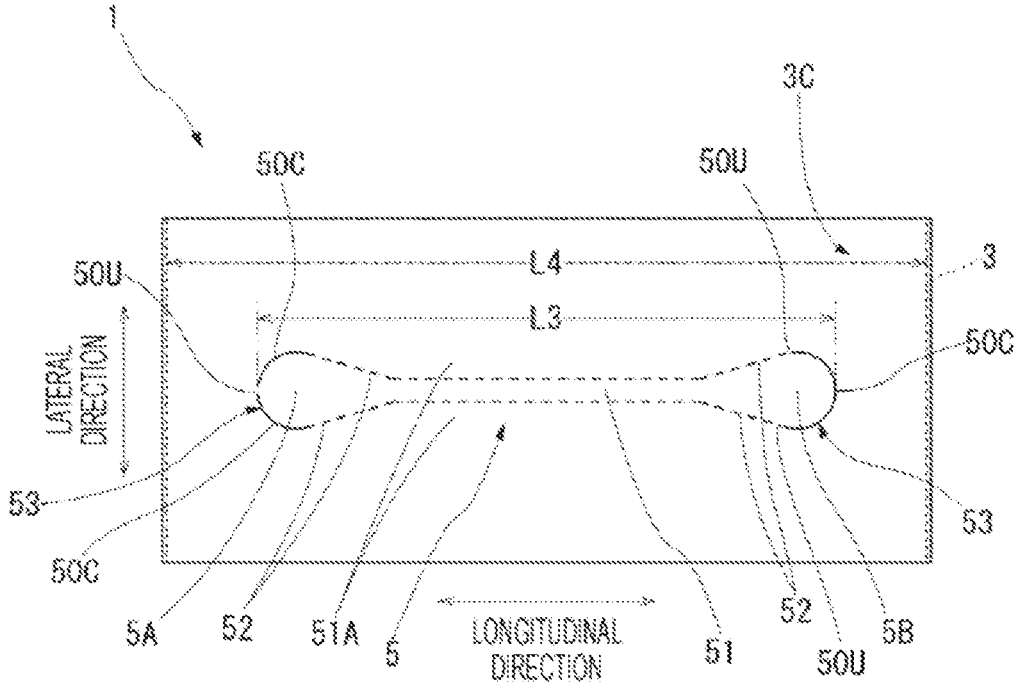
FIG. 5 is a top view for illustrating another outlet forming portion for a film-packaged tissue according to the present invention.
Figure 6:
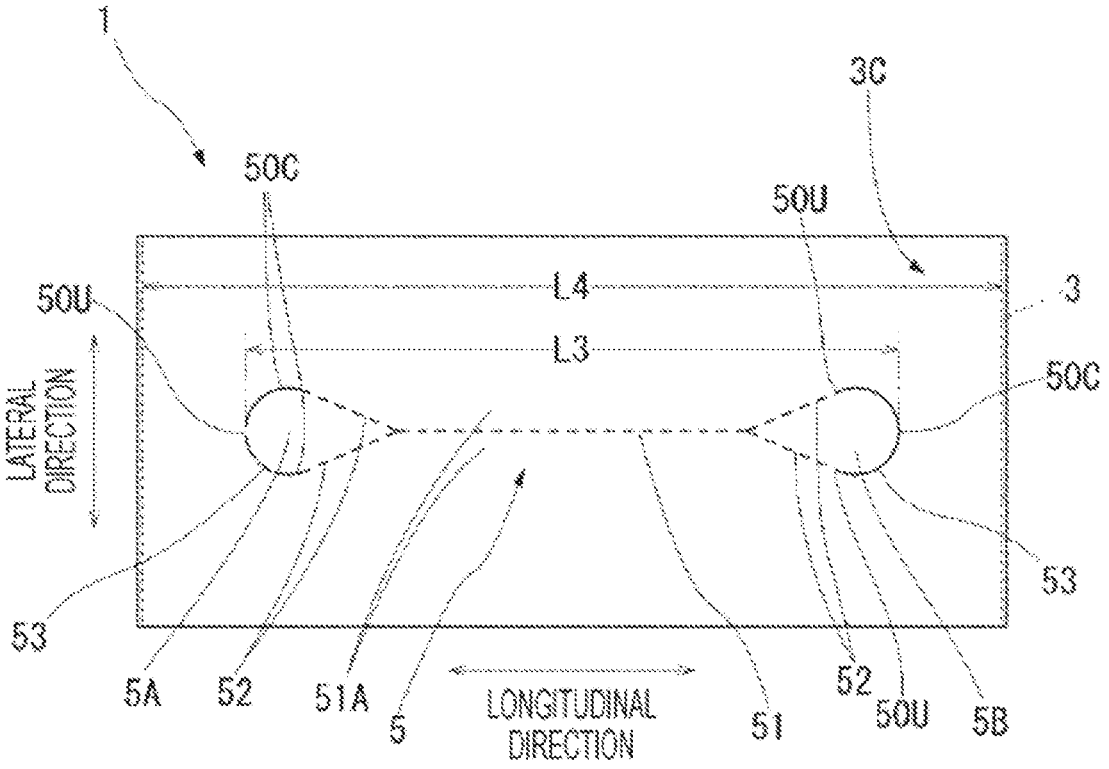
FIG. 6 is a top view for illustrating another outlet forming portion for a film-packaged tissue according to the present invention.
Figure 7:
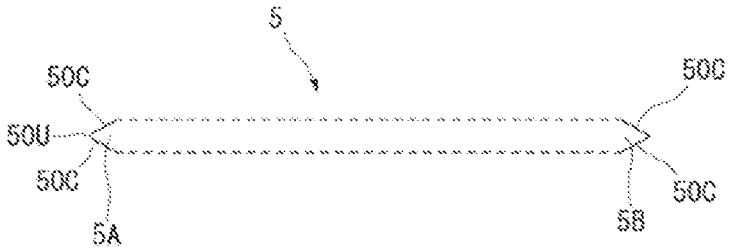
FIG. 7 is a top view for illustrating still another outlet forming portion for a film-packaged tissue according to the present invention.
Figure 7:
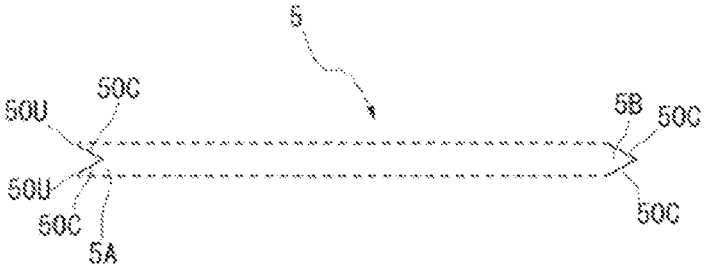

The outlet forming portion 5 according to the present invention has a shape in which characteristically, longitudinal-direction end portions 5A and 5B protrudes toward the outside in the longitudinal direction. Examples of the specific shape include shapes in which easily tearable lines located at longitudinal-direction end portions 5A and 5B are arranged in such a manner that they are curved so as to protrude toward the outside in the longitudinal direction as shown in FIGS. 4 to 6. In addition, examples thereof include shapes in which easily tearable lines located at longitudinal-direction end portions 5A and 5B are arranged in a V shape, a wedge shape or a W shape protruding toward the outside in the longitudinal direction as shown in FIG. 7.

When the longitudinal-direction end portions 5A and 5B are shaped to protrude toward the outside in the longitudinal direction as described above, the protruding portion of one end portion is easily grasped, and the easily tearable line is easily peeled off continuously while being grasped and moved toward the other end portion, so that excellent openability is attained. In addition, since the root portion of tissue paper partially exposed from the outlet is deformed along the convex portion, the tissue paper easily rises and is less likely to fall into the inside.

Figure 13:
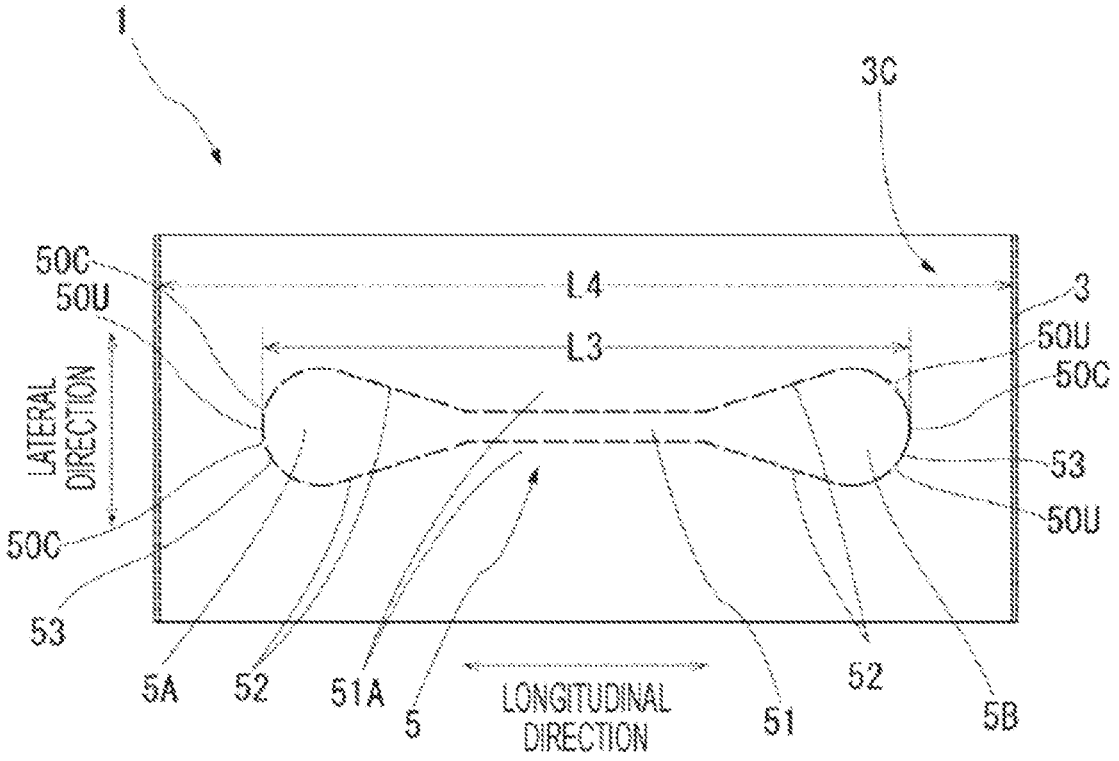
FIG. 13 is a top view for illustrating another outlet forming portion for a film-packaged tissue according to the present invention.

In particular, as a suitable shape of the outlet forming portion 5, a shape is desirable in which a slit portion 51 extending in the longitudinal direction, a wide portion 52 communicating with an end portion of the slit portion 51 and gradually increasing in width with distance from the slit portion 51 in the longitudinal direction and a curved portion 53 continuously protruding toward the outside in the longitudinal direction are present at the central portion of the upper surface 4C in the lateral direction, as shown in FIGS. 5, 6 and 13. In this case, the length L3 of the portion having the outlet forming portion 5 is shorter than the longitudinal-direction length L4 of the bundle 3, preferably approximately 60 to 80% of the longitudinal-direction length L4 of the bundle 3.

The width (lateral-direction length) of the slit portion 51 is 10 mm or less, preferably 7 mm or less in the lateral direction. As shown in FIG. 6, the slit portion may be one having substantially no width, which is formed by opening linear perforations. However, when the easily tearable line is formed in a substantially annular shape in the outlet forming portion 5 as shown in FIGS. 4 and 6, there is an advantage that the portion surrounded by the easily tearable lines can be continuously peeled off from one longitudinal-direction end portion 5A to the other longitudinal-direction end portion 5B, so that the outlet can be easily formed.

In the outlet formed as a shape of the outlet forming portion 5 shown in FIGS. 5, 6 and 13, a near-edge area 51A of the slit portion 51 is a free edge segment that easily moves in the up-down direction, and therefore when a set of tissue paper is drawn out from the bundle, the edge segment of the outlet is deformed in a draw-out direction, and leaned to support a next exposed set of tissue paper. In addition, the next tissue paper partially exposed from the outlet following the tissue paper drawn out from the bundle 3 is easily deformed into a shape having high uprightness because the longitudinal-direction edge portion thereof is wound along the edge of the curved portion 53. In particular, the outlet forming portion 5 shown in FIGS. 5 and 6 hardly causes falling of the tissue paper into a space inside the overwrap packaging, which is likely to occur in the overwrap packaging in which the outer packaging has a rectangular parallelepiped shape.

The cut tie ratio in the perforation and the slit cut with a non-cut portion, which form the outlet forming portion 5, is set within an appropriate range depending on the ease of breakage of a film used, and it is possible to select the length of the cut portion from the range of 0.8 mm or more and 20.0 mm or less and the length of the non-cut portion (tie portion or uncut portion) from the range of 0.3 mm or more and 5.0 mm or less.

In addition, rather than forming the entire outlet forming portion 5 according to the present invention by perforations, longitudinal-direction end portions 5A and 5B can be formed by slit cuts provided with non-cut portions (also referred to as uncut portions) and the area between the end portions can be formed by perforations as shown in FIGS. 4 to 7. In addition, only one longitudinal-direction end portion may be formed by slit cuts, and the other portions may be formed by perforations. In the example shown in FIGS. 5 and 6, the slit portion and the wide portion are formed by perforations, and the curved portion 53 is formed by a slit cut partially provided with uncut portions. In the example shown in FIG. 13, one longitudinal-direction end portion 5A is formed by a slit cut, and the remaining area extending to the other longitudinal-direction end portion 5B is formed by perforations. Therefore, in the outlet forming portion 5 according to the present invention, the interval between the cut portion and the non-cut portion and the lengths of the cut portion and the non-cut portion may partially vary. In this case, of course, the cut tie ratio partially varies. Even when the interval between the cut portion and the non-cut portion and the lengths of the cut portion and the non-cut portion vary, it is desirable that adjustment be made within the above-described ranges of the length of the cut portion and the length of the non-cut portion.

Here, the outlet forming portion 5 according to the present invention has a shape in which the longitudinal-direction end portions 5A and 5C protrude toward the outside as described above, and the interval between non-cut portions at one end portion is smaller than the interval between non-cut portions at the other end portion. When the interval between non-cut portions at one end portion is smaller than the interval between non-cut portions at the other end portion, the longitudinal-direction end portions of the outlet forming portion 5 are less likely to be turned up and the risk of being unintentionally opened becomes considerably lower when the upper surface of the film-packaged tissue is rubbed from the end portion 5A side with a short interval between non-cut portions to the opposite longitudinal-direction end portion 5B side than when the upper surface of the film-packaged tissue is rubbed from the end portion 5B side with a large interval between non-cut portions to the opposite longitudinal-direction end portion 5A side.

Here, the lengths of the cut portion and the non-cut portion may be appropriately determined according to the type and the thickness of the packaging film as described above, it is desirable that the length of the cut portion be 5.0 to 20.0 mm at the end portion with a large interval between non-cut portions, and on the other hand, the length of the cut portion be 0.8 to 10.0 mm at the end portion with a small interval between non-cut portions.

In addition, in the outlet forming portion shown in FIGS. 4 to 7, the longitudinal-direction end of the longitudinal-direction end portion 5A with a small interval between non-cut portions is the non-cut portion 50U. In this configuration, since the longitudinal-direction end is the non-cut portion 50U, the longitudinal-direction end portion 5A of the outlet forming portion 5 is extremely hardly turned up and the risk of being unintentionally opened is considerably reduced even if the upper surface of the film-packaged tissue is rubbed from the longitudinal-direction end portion 5A side, on which the non-cut portion 50U is provided, toward the opposite longitudinal-direction end portion 5B side. In addition, in the outlet forming portion shown in FIGS. 4 to 7, the longitudinal-direction end of the opposite longitudinal-direction end portion 5B with a large interval between non-cut portions is the cut portion 50C. In the outlet forming portion 5 having this configuration, the end edge of the end portion 5B where the longitudinal-direction end is the cut portion 50C is easily grasped, leading to excellent opening operability. However, for example, when the packaging film 4 is a uniaxially oriented film stretched in a direction orthogonal to the longitudinal direction of the outlet forming portion, or depending on the thickness of the film, there may be the possibility that the non-cut portion 50C at the end on the end portion A side is not cut and thus the packaging film 4 is torn with the non-cut portion as an origination point if the end portion 5B is grasped and the outlet forming portion 5 is peeled toward the end portion 5A. In such a case, both ends in the longitudinal direction may be cut portions as in the outlet forming portion shown in FIG. 13. When an end of the end portion 5A with a small interval between non-cut portions is a cut portion, the length of the cut portion located at each of both ends of the cut portion is preferably 8 mm or less. The length of the cut portion is more preferably 5 mm or less, particularly preferably 4 mm or less. In this way, the end portion is unlikely to be unintentionally turned, and the tear of the packaging film can be prevented.

The configuration of the outlet forming portion 5 of the film-packaged tissue 1 according to the present invention has an excellent advantage that the end portion 5A is hardly turned up during and after inclusion of the film-packaged tissue in a gusset packaging bag in the arrangement form of the film-packaged tissue 1 according to the present invention.

On the other hand, specific examples of the flexible packaging film 4 made of resin, which forms the outer packaging of the film-packaged tissue 1 include a monolayer film of polyethylene, polypropylene, polyester, polyethylene terephthalate, nylon, vinylidene chloride, and ethylene vinyl alcohol copolymer, and a laminate film including these films which are appropriately stacked, and a gas barrier film obtained by subjecting these films to surface treatment such as aluminum vapor deposition. In addition, a biomass film derived from plant raw materials such as sugar cane, potato (starch) and corn can be used. The use of such a biomass film is desirable from the viewpoint of environmental protection.

Polypropylene films and polyethylene films are suitable from the viewpoint of cost. The packaging film 4 may be a matte film excellent in design property and hand feel property. Further, when odorous materials such as scented tissue paper are packaged, ethylene vinyl alcohol copolymer resin films and polyethylene terephthalate resin films having an excellent aroma retaining property are desirable. The film may be a multilayer resin film in which a polyethylene resin film or a polypropylene resin film is stacked on one surface or both surfaces of an ethylene vinyl alcohol copolymer resin film or a polyethylene terephthalate resin film to improve heat weldability.

The thickness of the packaging film 4 may be appropriately selected with consideration given to flexibility, cost, gas permeability, and heat weldability, and it is desirable that the packaging film 4 have a thickness of 25 to 75 μm as measured in accordance with JIS P 8118 (1998) and a softness of 5.0 to 50.0 cN as measured by a handle-o-meter method conforming to JIS L 1096 (2010) E method. When the thickness is 25 to 75 μm, the stiffness of the end surface 4A is sufficiently enhanced particularly in the case of overwrap packaging. In addition, when having such a thickness and softness, the packaging film 4 is hardly broken, and is likely to be excellent in drawability, particularly pop-up property, of tissue paper. The thickness is measured using a dial thickness gauge (thickness measuring instrument) "PEACOCK G-1A Type" (manufactured by OZAKI MFG. CO., LTD.) or an equivalent machine after the measurement sample is sufficiently humidity-conditioned under the conditions of JIS P 8111 (1998).

In the film-packaged tissue assembly package 10 according to the present invention, a plurality of film-packaged tissues 1 are gusset packaged in the gusset packaging bag 13 in such a manner that the end surface 4A faces the top surface side on which a grip portion is present and the bottom surface side opposed to the top surface side, and the longitudinal direction is along the vertical direction.

The gusset packaging is a wrapping mode in which the film-packaged article to be gusset-packaged is included in a bag-shaped space present between bonded portions 41 and 42 formed by heat welding or the like on the top and bottom sides, and in particular, gusset portions 43 and 43 are present between the front surface and the back surface. In the gusset packaging, the gusset packaging bag 13 serving as an outer packaging includes gusset portions 43 and 43 formed by opening side portions 40E and 40E folded in a flat state, and surfaces connected to the gusset portions 43. The second surfaces connected to the gusset portions 43 and 43 are a front surface 46 and a back surface 46, the front surface 46 and the back surface 46 are relative to each other, and which surface is the front surface is not limited.

Figure 11:
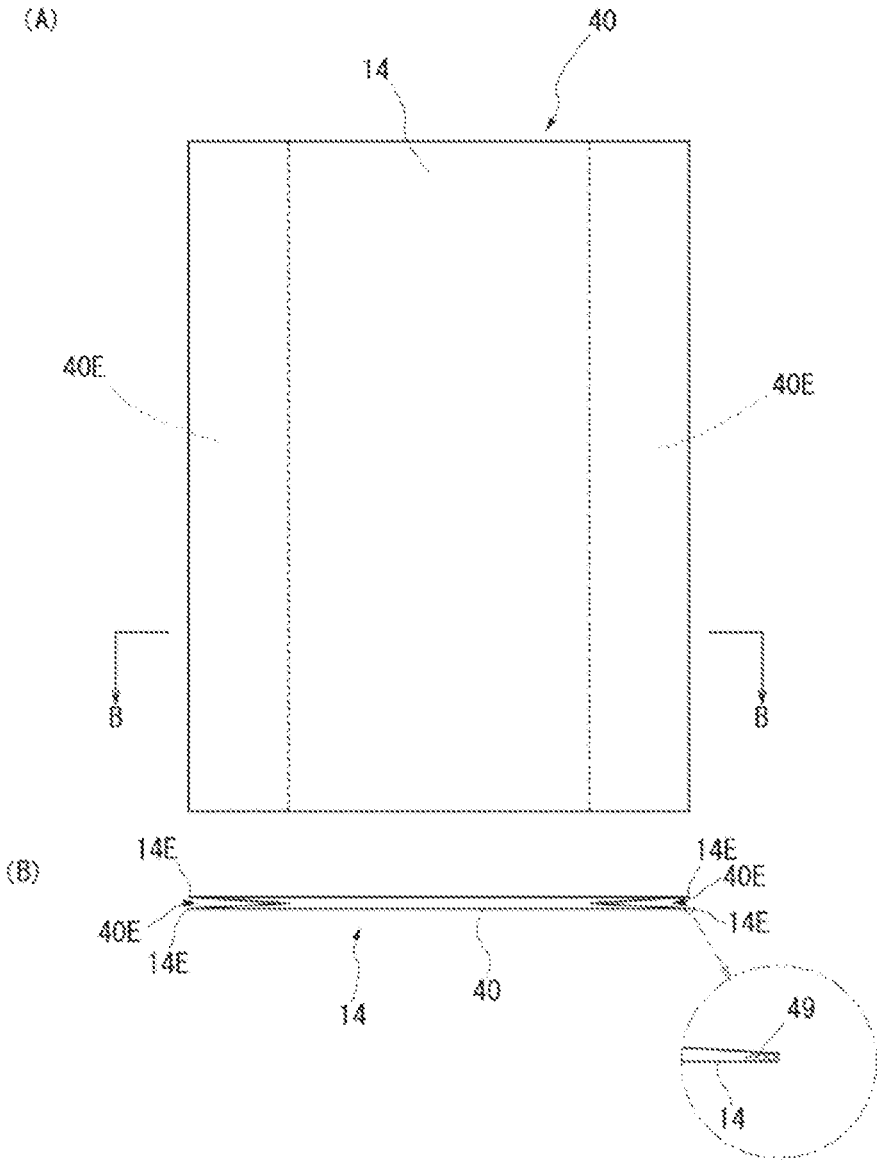
FIG. 11 is a perspective view for illustrating a gusset packaging bag according to the present invention.
Figure 12:
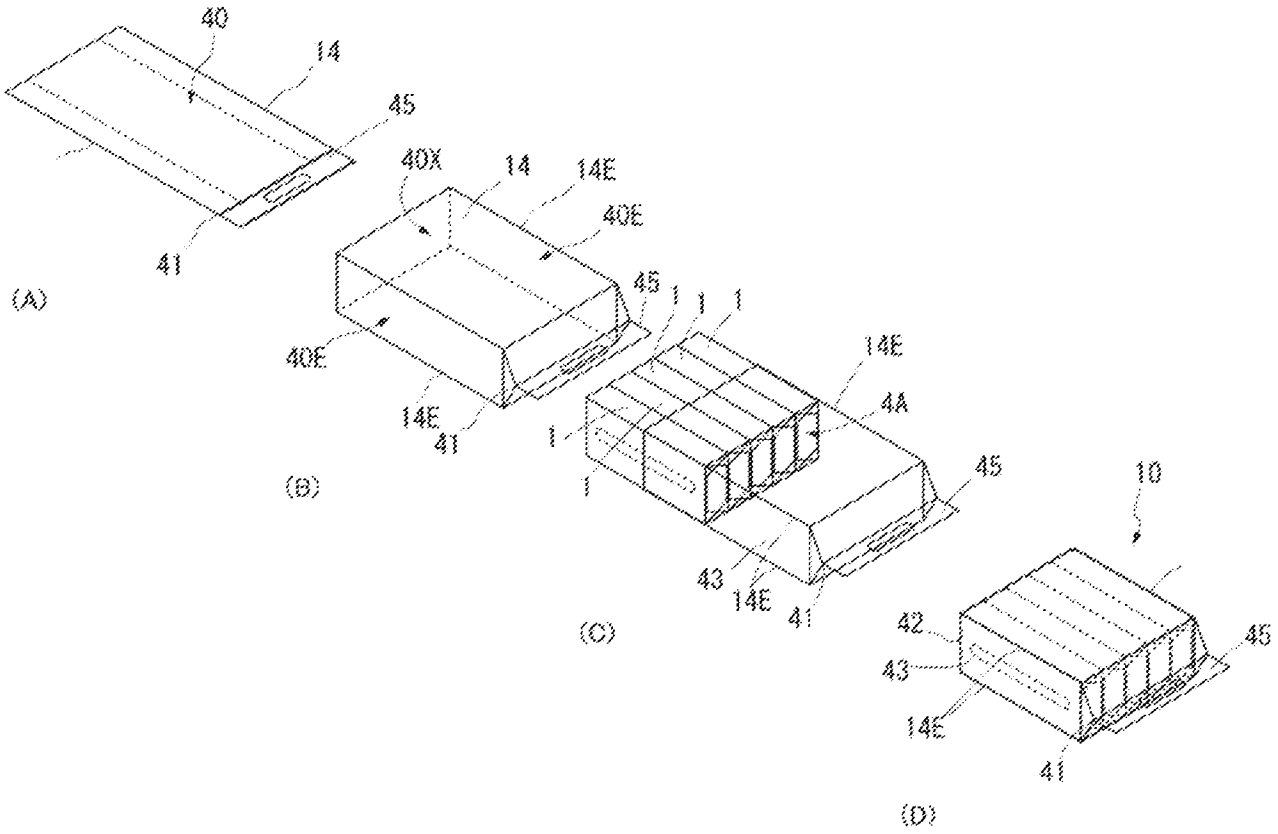
FIG. 12 is a perspective view for illustrating a method for producing a gusset packaging related to a film-packaged tissue assembly package according to the present invention, and a structure thereof.

Here, in general, as shown particularly in FIGS. 11 and 12, side portions 40E and 40E of the barrel shaped gusset packaging film 14 also called a gusset tube 40 are folded to the inside of a bag to flatten the gusset tube, a portion on the top surface side of the gusset tube is heat-welded to seal an opening on the top surface side as a top surface side sealing portion 41 and form a grip portion 45, a bottom surface side opening 40X of a gusset packaging bag precursor sealed only on the top surface side is then expanded, the assembly of the film-packaged tissues as the article to be packaged is inserted through the bottom surface side opening, and the bottom surface side opening is then sealed by appropriate sealing means such as heat sealing to form the lower sealing portion 42.

In the method for producing a film-packaged tissue assembly package in the present invention, a film-packaged tissue assembly is formed in which characteristically, a plurality of film-packaged tissues 1 are disposed with the end surfaces 4A being substantially flush with each other and the long side surfaces 4B being substantially flush with each other, so that the film-packaged tissues are arranged in a substantially rectangular parallelepiped shape when the film-packaged tissue 1 is inserted into a gusset packaging bag precursor of the package. Among the film-packaged tissues 1 in the assembly, at least the film-packaged tissue 1 having the upper surface 4C contacting the gusset packaging film 14 is inserted from the longitudinal-direction end portion 5A side with a smaller interval between non-cut portions 50U. Of course, the film-packaged tissues may be arranged in such a manner that all the film-packaged tissues 1 forming the assembly are inserted from the longitudinal-direction end portion 5A side with a smaller interval between non-cut portions 50U. Further, it is desirable to include a compression step of compressing the film-packaged tissue assembly in a direction along which upper and lower surfaces are arranged.

When as described above, a film-packaged tissue assembly is formed by disposing a plurality of substantially hexahedron-shaped film-packaged tissues 1, in which the outlet forming portion 5 according to the present invention is formed on the upper surface 4C, where the outlet forming portion has a shape in which an easily tearable line having cut portions 50C and non-cut portions 50U arranged alternately protrudes toward the outside in the longitudinal direction, and the interval between non-cut portions at one end portion 5A is smaller than the interval between non-cut portions at the other end portion 5B, with the end surfaces 4A being substantially flush with each other and the long side surfaces 4B being substantially flush with each other, so that the film-packaged tissues are arranged in a substantially rectangular parallelepiped shape, and the film-packaged tissue assembly is inserted from a side where the end portion 5A with a small interval between non-cut portions is present at the time when the film-packaged tissue assembly is inserted into a barrel-shaped film closed on one side or opened at both ends, which is a precursor of a gusset packaging bag, the outlet forming portion 5 is hardly turned up from the longitudinal-direction end portion 5A side thereof and thus the outlet forming portion 5 is prevented from being torn and opened unintentionally during production even if the gusset packaging film 14 forming the gusset packaging bag and the outlet forming portion 5 formed on the upper surface 4C of the film-packaged tissue 1 are rubbed against each other during the insertion. In addition, formation of an assembly package having a poor appearance in which one longitudinal-direction end portion 5A of the outlet forming portion 5 is turned up is prevented.

On the other hand, the grip portion 45 of the gusset packaging is an extra portion provided on the top surface side of the top surface side sealing portion 41, which is a boundary on the top surface side with the bag portion including the film-packaged tissue 1, for enhancing the portability of the assembly package 10. In the illustrated form, a finger hook hole 47 is formed. When the finger hook hole 47 is formed in the grip portion 45 as described above, the portability of the assembly package is further enhanced.

In addition, in the assembly package 10 according to the present invention, it is desirable that a notch portion 70 for opening by a perforation or the like be formed for facilitating opening as shown in FIGS. 1 and 2. Further, it is desirable that the notch portion be provided on the top surface portion 44 extending from the front surface 46 or the back surface 46 to the grip portion 45, which corresponds to an area Z1 extending to the front surface 46 and the back surface 46 from the lower end of a portion provided with the finger hook hole 47. In the top surface portion 44, a force applied to the top surface portion 44 varies depending on a position of the finger hook hole 47 when the tissue is lifted with the finger placed in the finger hook hole 47. Specifically, the tensile forces on the region Z1 extending to the front surface 46 and the back surface 46 from the lower end of the portion of the grip portion 45 which is provided with the finger hook hole 47 is smaller than that on the region extending to the front surface 26 and the back surface 26 from the lower end of the portion which is not provided with the finger hook hole 47. In addition, the top surface portion 44 is a portion that is easily visible to the user.

Therefore, when the notch portion 70 is provided at such a position, unintentional opening does not occur during carriage, and it is easy to visually recognize the notch portion 70. The shape of the notch portion is not particularly limited, and as in the illustrated example, it is desirable that the notch portion have a protruding shape toward the grip portion side, for example, a substantially arc shape. When the notch portion has this shape, a knob piece 70A is formed by pushing the notch portion 70 to tear the perforation or the like, and when this is drawn toward the bottom surface, an opening port is easily formed over the gusset packaging bag front surface or back surface as shown in FIG. 8. The cut tie ratio of the perforation may be appropriately determined.

On the other hand, it is desirable that the gusset packaging film 14 be a polypropylene film or a polyethylene film from the viewpoint of cost and an openability. The melting point of the film is preferably 150° C. or lower. A lower melting point of the packaging film is more preferable in sealing and formation of a grip portion because heat welding treatment can be performed at a lower temperature. If the melting point is excessively low, there is an increased possibility that the packaging film is scratched or a hole is formed by, for example, friction particularly with a square portion 4*t* of the end surface 4A of the film-packaged tissue 1. Therefore, the substantial lower limit is 80° C. Examples of the polyethylene film include linear low-density polyethylene films (LLDPE), low-density polyethylene films (LDPE) and medium-density polyethylene films (MDPE). Among them, in the present invention, linear low-density polyethylene film layers (LLDPE) having a density of 0.910 to 0.940 g/cm$^3$ and a melting point of 110 to 120° C. are particularly suitable from the viewpoint of heat weldability and cost. A monolayer film of polyethylene terephthalate, nylon, vinylidene chloride, and ethylene vinyl alcohol copolymer, a laminate film including any of these films which are appropriately stacked, or a gas barrier film obtained by subjecting any of these films to surface treatment such as aluminum vapor deposition. As in the case of the packaging film 4, biomass films derived from plant raw materials such as sugar cane, potato (starch) and corn can be used. The use of such a biomass film for the gusset packaging film is also desirable from the viewpoint of environmental protection.

The thickness of the gusset packaging film 14 forming the gusset packaging bag 13 is appropriately selected with consideration given to a relationship with the included film-packaged tissue 1 in addition to the flexibility, cost, and heat weldability during packaging, the circumstances peculiar to gusset packaging, such as tearability that enables easy opening during opening, abrasion resistance particularly against the end surface square portion 4*t* of the included film-packaged tissue 1, and flexibility which ensures that an excessive load is not applied to a finger when the packaging bag is carried with the finger put in a finger hook hole provided on the grip portion.

For the preferred thickness and softness of the gusset packaging film 14 from the above-mentioned viewpoint, the thickness measured in accordance with JIS P 8118 (1998) is 10 to 65 μm, and softness measured by a handle-o-meter method conforming to JIS L 1096 (2010) E method is 5.0 to 50.0 cN.

In particular, it is desirable that the softness of the gusset packaging film 14 forming the gusset packaging bag 13 be lower than the softness of the packaging film 4 forming the film-packaged tissue 1. In the gusset packaging bag 13 having a grip portion on the top surface side, the gusset packaging bag 13 is pulled in a vertical direction when the grip portion 45 is held, and therefore at this time, pressure may be applied to the film-packaged tissues 1, 1 . . . , which are packaged articles included, but when the softness of the gusset packaging film 14 is low, the rectangular parallelepiped shape of the included film-packaged tissue 1 is hardly deformed, the inside bundle 3 is not pressurized, fullness is hardly deteriorated, and drawability such as a pop-up property is hardly deteriorated.

On the other hand, in the film-packaged tissue assembly package 10 according to the present invention, the arrangement configuration of film-packaged tissues 1 in the gusset packaging bag 14, which is also a configuration obtained by the above-described production method is such that a plurality of film-packaged tissues 1,1 . . . are arranged so as to form a substantially rectangular parallelepiped shape as a whole with the end surfaces 4A being substantially flush with each other and the long side surfaces 4B being substantially flush with each other as shown in the figures.

When the film-packaged tissues are arranged in a substantially rectangular parallelepiped shape as described above, stability and shape retainability as a whole of the assembly are enhanced, and the assembly is hardly collapsed or ruptured by an external force. In addition, when the film-packaged tissues are arranged in this manner, an assembly of the film-packaged tissues 1 has a rectangular parallelepiped shape in which an end surface assembly surface having high stiffness is formed on the top and bottom surfaces, resulting in reduction of the possibility that the film-packaged tissue 1 is ruptured or the film-packaged tissue 1 is damaged by an external force particularly in the vertical direction.

Further, in the film-packaged tissue assembly package 10 according to the present invention, the film-packaged tissues are packaged such that the outlet forming portion 5 for the film-packaged tissue is formed by an easily tearable line having cut portions 50C and non-cut portions 50U arranged alternately, and has a shape in which the longitudinal-direction end portions 5A and 5B protrude toward the outside, the interval between non-cut portions at one end portion is smaller than the interval between non-cut portions at the other end portion, and the side where the end portion with a small interval between non-cut portions is present is located on the top surface side.

Here, for the gusset packaging bag 13 having the grip portion 45 on the top surface side, the gusset packaging bag 13 is pulled in the vertical direction when the grip portion 45 is held and subsequently, the gusset packaging bag is placed with the bottom on the lower side. At this time, the film-packaged tissue included may be rubbed with the packaged article and the gusset packaging film 14. At this time, the rubbing easily occurs particularly on the top surface side where there is an abundance of internal space. Therefore, when the film-packaged tissue is packaged, as in the present invention, in such a manner that the side where the end portion 5A with a small interval between non-cut portions is present is located on the top surface side, the possibility decreases that the end portion 5A of the outlet forming portion 5 is turned up or the outlet forming portion is unintentionally opened if such rubbing occurs.

On the other hand, in the assembly package according to the present invention, film-packaged tissues 1, 1 . . . are packaged in such a manner that the longitudinal direction is along the vertical direction with the end surfaces 4A facing the top surface side where the grip portion 45 is present, and the bottom surface side opposed to the top surface side, and two or less stages in the vertical direction are desirable as the number and the assembly configuration of the film-packaged tissues 1 in the gusset packaging bag 13. If the number of stages in the vertical direction is more than two, the shape retainability of the assembly package is deteriorated. Specifically, in the assembly package 10 according to the present invention, the longitudinal direction of the film-packaged tissue 1 is a direction along the vertical direction, and therefore if the number of stages is more than two and three or more, uprightness in the vertical direction is deteriorated, and slippage is easily generated between the stages, so that the gusset packaging film 14 and the film-packaged tissue 1 are easily rubbed with each other.

The number of film-packaged tissues 1 arranged in a direction orthogonal to the vertical direction is not particularly limited, and six or less rows are desirable. Examples of the preferred configuration include an arrangement configuration of a total of five or six tissues with one stage in the vertical direction and five rows or six rows (not shown) in a direction orthogonal to the vertical direction as shown in FIG. 1; an arrangement configuration of a total of ten or twelve tissues with two stages in the vertical direction and five rows or six rows (not shown) in a direction orthogonal to the vertical direction as shown in FIG. 2; and an arrangement configuration of a total of ten or twelve tissues with one stage in the vertical direction, five rows or six rows in a direction orthogonal to the vertical direction and two rows in a horizontal direction (not shown). These arrangement configurations are excellent in rectangular parallelepiped shape retainability and upright stability, in addition to portability and stacking capacity at the storefront, and can ensure a sufficient number of products with respect to a general purchase frequency.

Further, in the film-packaged tissue assembly package 10 according to the present invention, it is desirable that the bundle filling ratio of the film-packaged tissue 1 be 100% or more. Here, the bundle filling ratio is a ratio of the height of the bundle 3 drawn out from the packaging film 4 to the height of the film-packaged tissue 1. For the specific measurement method, first, the film-packaged tissue 1 is humidity-conditioned for 24 hours under an environment of a standard condition of 23° C.±1° C. and a humidity of 50±2% r.h in accordance with JIS P 8111, and placed on a horizontal table with the upper surface facing upward, and the height of the film-packaged tissue 1 is measured. The measured value is an average of values obtained by measuring the distance L1 between the sharp portions of the square portions 4*t* of the end surfaces 4A at four points. Next, the film-packaged tissue 1 is drawn out from the bundle 3, and humidity-conditioned for 24 hours under an environment of a standard condition of 23° C.±1° C. and a humidity of 50±2% r.h in accordance with JIS P 8111, and placed on a horizontal table with the upper surface facing upward, and the height of the bundle 3 is measured. The measured value is an average of values obtained by measuring the distance between the square portions of the short side surface 3A facing the end surfaces 4A. Next, a ratio of the height of the bundle 3 drawn out from the packaging film 4 to the height of the film-packaged tissue 1 is calculated from each measured value.

In such a film-packaged tissue 1 having a bundle filling ratio of more than 100%, the bundle 3 pushes the packaging film 4 from the inside. In the overwrap packaging, the end surface 4A has high stiffness and is difficult to stretch or deform. On the other hand, portions facing the upper and lower surfaces and the long side surfaces of the bundle 3 of the packaging films 4 have flexibility, and therefore the positions and the longitudinal edges 1E of these portions are deformed so as to very slightly protrude. When the film-packaged tissue 1 in which the longitudinal edge 1E protrudes as described above is assembly-packaged in such a manner that the longitudinal direction is along the vertical direction with respect to the top surface side where the grip portion 45 is present and the bottom surface side facing the top surface side, the square portion 4*t* of the end surface 4A may be hardly abut against the gusset packaging film 14 forming the gusset packaging bag 13 by protrusion of the longitudinal edge 1E when the gusset packaging bag is pulled in the vertical direction by holding the grip portion 45, so that the risk of breakage of the gusset packaging bag 13 decreases.

Further, in the film-packaged tissue assembly package 10 according to the present invention, it is desirable that the compression ratio in a direction orthogonal to the vertical direction of a film-packaged tissue assembly arranged in the gusset packaging bag be 80% or more. Here, the compression ratio in a direction orthogonal to the vertical direction is a ratio of (the distance between the gusset portions of the gusset packaging bag (the width of the front surface or the back surface)) L2 to (the length of the film-packaged tissue assembly in a non-packaged state in a direction orthogonal to the vertical direction) where the film-packaged tissue 1 is packaged in such a manner that the gusset portion 43 of the gusset packaging bag 14 faces the upper and lower surfaces 3C of the film-packaged tissue 1. The length of the film-packaged tissue assembly in a non-packaged state in a direction orthogonal to the vertical direction is calculated by (height of one film-packaged tissue in vertical direction)× (number of tissues arranged in direction orthogonal to vertical direction). The height of one film-packaged tissue in the vertical direction is different from the height associated with the bundle filling ratio, and is measured as follows.

First, individual film-packaged tissues 1 are draw out from the film-packaged tissue assembly package 10, and humidity-conditioned for 24 hours under an environment of a standard condition of 23° C.±1° C. and a humidity of 50±2% r.h in accordance with JIS P 8111. Next, the film-packaged tissue 1 is placed on a horizontal table, and a hard polyacrylate plate sized to protrude from each edge (short side edge and long side edge) of the upper surface of the bundle 3 by 5 cm or less is placed on the upper surface of the bundle 3. When the size of the upper surface of the bundle is 160 to 200 mm in the longitudinal direction (width)×90 to 110 mm in depth, the size of the polyacrylate plate may be 250 mm×130 mm. The mass is 32 g or less. Next, the height of polyacrylate plate from the square horizontal table is measured, and an average value thereof is calculated. This measurement is performed for all film-packaged tissues drawn out. A further average value of the calculated average values is defined as a height of one film-packaged tissue 1 in the vertical direction. A value obtained by multiplying the calculated value by the number tissues arranged is defined as a "length of the film-packaged assembly in a non-packaged state in a direction orthogonal to the vertical direction". Subsequently, a distance between the gusset portions 43 of the gusset packaging bag 13 is measured.

The measured value is an average of values obtained by measuring each of the width of the front surface 46 (distance between fold lines of the front surface) and the width of the back surface 46 (distance between fold lines of the back surface) at three points. Subsequently, a ratio of the distance between the gusset portions (the width of the front surface or the back surface) of the gusset packaging bag 13 to the length of the film-packaged assembly in a non-packaged state in a direction orthogonal to the vertical direction is calculated.

If the compression ratio in a direction orthogonal to the vertical direction of the film-packaged tissue assembly arranged in the gusset packaging bag 13 is less than 80%, the end surface 4A is distorted and the fullness of the tissue paper 2 is easily deteriorated because of the excessively high compression ratio. The upper limit of the compression ratio is not particularly limited in the wrapping mode according to the present invention. The compression ratio is not limited as long as the film-packaged tissue does not move excessively in the gusset packaging bag. The compression ratio is not necessarily required to be 100% or less. However, when the compression ratio is 100% or less, movement of the film-packaged tissue assembly is restricted by an outer packaging film forming the gusset packaging bag, the outlet forming portion 5 is less likely to be turned up, the assembly package does not collapse, and the shape retainability of the rectangular parallelepiped is enhanced. It is more desirable that the compression ratio be 100% or less.

On the other hand, individual tissue paper 2 forming the bundle 3 packaged in the film-packaged tissue 1 has a ply structure in which two to three thin sheets having a crepe are laminated to form a set. The tissue paper 2 is a dry-type tissue paper, and is not a so-called wet-type tissue paper which is impregnated with a chemical liquid. Therefore, the bundle 3 formed by the tissue paper 2 contains a large amount of air. Some of dry-type tissue papers 2 are chemical liquid-addition-type tissue papers in which a chemical liquid such as a moisturizing component increasing moisture by moisture absorption, such as a polyol typified by glycerin, and such tissue papers are included. Rather, the chemical liquid-addition-type tissue paper has a high moisture content, and is therefore less restorable when compressed, the effect of little decrease in fullness according to the present invention is effectively exhibited. The moisture content of the chemical liquid-addition-type is about 10 to 14 mass %. The moisture content is a ratio of moisture contained in the tissue paper under a standard condition.

The raw material pulp of the thin sheet forming the tissue paper 2 is one obtained by blending NBKP and LBKP. Waste paper pulp may be blended, and the raw material pulp is preferably one composed only of NBKP and LBKP from the viewpoint of texture etc. The blending ratio is preferably NBKP:LBKP=20:80 to 80:20, particularly preferably NBKP:LBKP=30:70 to 60:40.

The basis weight per one thin sheet forming each ply of the tissue paper 2 is 10 to 25 g/m$^2$. The basis weight per ply is more preferably 10 to 18 g/m$^2$. The basis weight here is based on the measurement method of JIS P 8124 (1998). The sheet thickness of the tissue paper 2 in a state of 2 plies is 90 to 200 μm, more preferably 90 to 140 μm. The thickness is 120 to 300 μm in a state of 3 plies. The sheet thickness is a value obtained by sufficiently humidity-conditioning the test piece under the conditions of JIS P 8111 (1998) and then performing measurement in a state of multiple plies under the same conditions using a dial thickness gauge (thickness measuring instrument) "PEACOCK G Type" (manufactured by OZAKI MFG. CO., LTD.) or an equivalent machine.

When the tissue paper having the above-described basis weight and sheet thickness is formed into an assembly package having a low compression ratio according to the present invention, in particular, fullness is not reduced, and its effect is sufficiently exhibited. The vertical direction and the up-down direction in the present invention and the present description are appropriately changed depending on the orientation of the film-packaged tissue assembly package and the film-packaged tissue, and do not mean absolute directions.

REFERENCE SIGNS LIST

1, 101, 101A Film-packaged tissue
1E Longitudinal edge of film-packaged tissue
2 Tissue paper
2A Folded inner side
2B Folded piece
2C Folded edge
3 Tissue paper bundle
3A Short side surface
3B Long side surface
3C Upper and lower surfaces of bundle
4 Packaging film
4*t* Square portion of end surface
4X Superposed portion of packaging film
4Y Extending portion of packaging film
4Z Barrel opening of packaging film
4A, 140A Curved surface
4B Long side surface
4C Upper surface
5 Perforation for opening
10 Film-packaged tissue assembly package
13 Gusset packaging bag
14 Gusset packaging film
14E Fold line
40 Gusset tube
40E Side portion of gusset tube-shaped gusset packaging film
40X Bottom surface-side opening of gusset packaging bag precursor
41 Top surface-side sealing portion
42 Bottom surface-side sealing portion
43 Gusset portion
44 Top surface portion
45 Grip portion
46 Front surface and back surface
47 Finger hook hole
49 Bonding portion
5A, 5B Longitudinal-direction end portion
50C Cut portion
50U Non-cut portion (tie portion)
51 Slit portion
52 Wide portion
53 Curved portion
70 Notch portion
70A Knob piece
L1 Height-direction distance between square portions of end surfaces
L2 Width of front surface and back surface of gusset packaging bag
L3 Longitudinal-direction length of outlet forming portion 5
L4 Longitudinal-direction length of bundle

The invention claimed is:

1. A film-packaged tissue assembly package comprising:

a gusset packaging bag having a grip portion on the top surface side; and a plurality of film-packaged tissues having a substantially hexahedron shape having an upper surface having an outlet forming portion, a lower surface facing the upper surface, and an end surface and a long side surface located between the upper surface and the lower surface, the plurality of film-packaged tissues being arranged and packaged in the gusset packaging bag, wherein the plurality of film-packaged tissues are arranged in a substantially rectangular parallelepiped shape in such a manner that the end surfaces face the top surface side where the grip portion is provided, and a bottom surface side facing the top surface side, and the end surfaces are substantially flush with each other and the long side surfaces are substantially flush with each other, and a film-packaged tissue is packaged in such a manner that the outlet forming portion is formed by an easily tearable line having cut portions and non-cut portions arranged alternately, and has a shape in which both end portions in a longitudinal direction protrude toward the outside, the interval between non-cut portions at one end portion being smaller than the interval between non-cut portions at the other end portion, and the side where the end portion with a smaller interval between non-cut portions being located on the top surface side.

2. The film-packaged tissue assembly package according to claim 1, wherein the end portion with a larger interval between non-cut portions is formed by a slit cut, and the end portion with a smaller interval between non-cut portions is formed by a perforation.

3. The film-packaged tissue assembly package according to claim 1, wherein both ends of the outlet forming portion for the film-packaged tissue in the longitudinal direction are cut portions.

4. The film-packaged tissue assembly package according to claim 1, wherein the plurality of film-packaged tissues are packaged in such a manner that among the end portions of the outlet forming portion for the film-packaged tissue in the longitudinal direction, the longitudinal-direction end on the end portion side with a smaller interval between non-cut portions is a non-cut portion, the longitudinal-direction end on the end portion side with a longer interval between non-cut portions is a cut portion, the end portion on a side where the non-cut portion is present is located on the top surface side, and the end portion on a side where the cut portion is present is located on the bottom surface side.

5. The film-packaged tissue assembly package according to claim 1, wherein the film-packaged tissue paper is an overwrap-packaged product of a tissue paper bundle having a substantially rectangular solid shape in which a plurality of tissue papers are folded and stacked, and an end surface formed by a barrel opening sealing portion is positioned so as to face a short side surface of the bundle.

6. The film-packaged tissue assembly package according to claim 1, wherein in the gusset packaging bag, the film-packaged tissues are arranged in a plurality of stages in the vertical direction in such a manner that the end surfaces of the film-packaged tissues are abutted against each other.

7. The film-packaged tissue assembly package according to claim 1, wherein a compression ratio in a direction orthogonal to the vertical direction of a film-packaged tissue assembly arranged in the gusset packaging bag is 80% or more.

8. A method for producing film-packaged tissue assembly package, the method comprising:

forming a film-packaged tissue assembly by disposing a plurality of substantially hexahedron-shaped film-packaged tissues, in which an outlet forming portion is formed on un upper surface, where the outlet forming portion has a shape in which an easily tearable line having cut portions and non-cut portions arranged alternately protrudes toward the outside from a longitudinal-direction end portion, and the interval between the cut portion and the non-cut portion at one end portion is smaller than the interval between the cut portion and the non-cut portion at the other end portion, and the film-packaged tissue has a lower surface facing the upper surface, and an end surface and a long side surface located between the upper surface and the lower surface, with the end surfaces being substantially flush with each other and the long side surfaces being substantially flush with each other, so that the film-packaged tissues are arranged in a substantially rectangular parallelepiped shape;

inserting the film-packaged tissue assembly into a bag closed on one side or a barrel-shaped film opened at both ends, which is a precursor of a gusset packaging bag, from the side where the end portion with a small interval between the cut portion and the non-cut portion; and sealing the opening of the bag or the barrel-shaped film to perform gusset-packaging.

9. The method for producing a film-packaged tissue assembly package according to claim 8, further comprising compressing the film-packaged tissue assembly in a direction along which the upper and lower surfaces are arranged.

* * * * *